United States Patent [19]

Feucht

[11] 3,955,478

[45] May 11, 1976

[54] HYDRAULICALLY POWERED PERCUSSION DRILL

[75] Inventor: Jacob Edward Feucht, Sidney, Ohio

[73] Assignee: Dresser Industries, Inc., Dallas, Tex.

[22] Filed: Oct. 29, 1973

[21] Appl. No.: 410,939

[52] U.S. Cl. ..... 92/85 B; 92/9; 173/134; 173/139; 188/284; 188/318

[51] Int. Cl.[2] ..... B25D 9/00; F01B 11/02

[58] Field of Search ..... 92/9, 85; 173/139, 134; 188/284, 286, 318, 316

[56] References Cited

UNITED STATES PATENTS

| | | | |
|---|---|---|---|
| 2,354,340 | 7/1944 | Utter | 188/318 X |
| 3,045,650 | 7/1962 | Ambrosini | 92/86 X |
| 3,220,517 | 11/1965 | Lorenz | 188/318 |
| 3,596,562 | 8/1971 | Foster et al. | 92/85 X |
| 3,701,386 | 10/1972 | Feucht | 173/78 |
| 3,887,019 | 6/1975 | Reynolds et al. | 173/134 |

*Primary Examiner*—Irwin C. Cohen

*Attorney, Agent, or Firm*—John N. Hazelwood; Roy L. Van Winkle

[57] ABSTRACT

The improved hydraulically actuated percussion drill described hereinafter is designed to reciprocate a striker piston contained therein regardless of whether or not the striker piston engages the drill steel whereby vibration can be imparted to the drill. The drill includes an overtravel portion that cooperates with the striker piston to prevent metal-to-metal contact of the striker piston with the housing during operation. Means are provided to prevent the loss of fluid from the overtravel chamber whereby the striker piston will be returned to the upper end of its stroke and will not become stalled in the overtravel chamber.

1 Claim, 3 Drawing Figures

HYDRAULICALLY POWERED PERCUSSION DRILL

BACKGROUND OF THE INVENTION

This invention relates generally to improvements in hydraulically powered percussion drills. More particularly, but not by way of limitation, this invention relates to an improved hydraulically powered percussion drill that will not become stalled when the drill is run free, that is, when the reciprocating striker piston is not engaging the drill steel.

The invention described hereinafter is an improvement to the hydraulically powered percussion drill described in U.S. Pat. No. 3,701,386, issued Oct. 31, 1972 to Jacob E. Feucht. The hydraulically powered percussion drill or hydraulic drifter as it is sometimes referred to described therein operates in a satisfactory manner except that it is desirable to be able to reciprocate the striker piston within the housing to impart vibrations to the drill steel when the striker piston is not actually engaging the drill steel. With the device described in the patent, the striker piston occasionally becomes stalled in the lowermost position when running free. It is frequently desirable to impart vibrations to the housing when retracting the drill to change drill steels, removing stuck steels from the hole being drilled and adding or removing drill steel sections.

Accordingly, it is one object of this invention to provide an improved hydraulically actuated percussion drill that will operate to provide vibration to the housing when the drill is running free.

Another object of the invention is to provide an improved hydraulically powered percussion drill that can be run free and that includes overtravel protection to prevent damage to the drill.

SUMMARY OF THE INVENTION

This invention provides an improved hydraulically powered percussion drill that includes a housing, a striker piston located for reciprocating movement in the housing, the piston and housing defining first and second chambers with one end of the piston being located in the second chamber. A flange on the piston is located in the first chamber, and an overtravel portion of the first chamber is sized to closely receive the flange for arresting the movement of the piston hydraulically. The improvement comprises means for maintaining the hydraulic pressure in the overtravel portion substantially equal to the pressure in the first chamber when the flange is disposed in the overtravel portion to prevent a differential in pressure across the flange in a direction to stall the piston.

The foregoing and additional objects and advantages of the invention will become more apparent as the following detailed description is read in conjunction with the accompanying drawing.

DETAILED DESCRIPTION OF THE PREFERRED EMBODIMENT

As mentioned hereinbefore, this invention constitutes an improvement to the percussion drill described in U.S. Pat. No. 3,701,386. The overall structure and operation of apparatus described in that patent will not be described in detail hereinafter. The disclosure of that patent is hereby incorporated by reference with regard to the details of structure and operation of the overall device.

Figure 1:
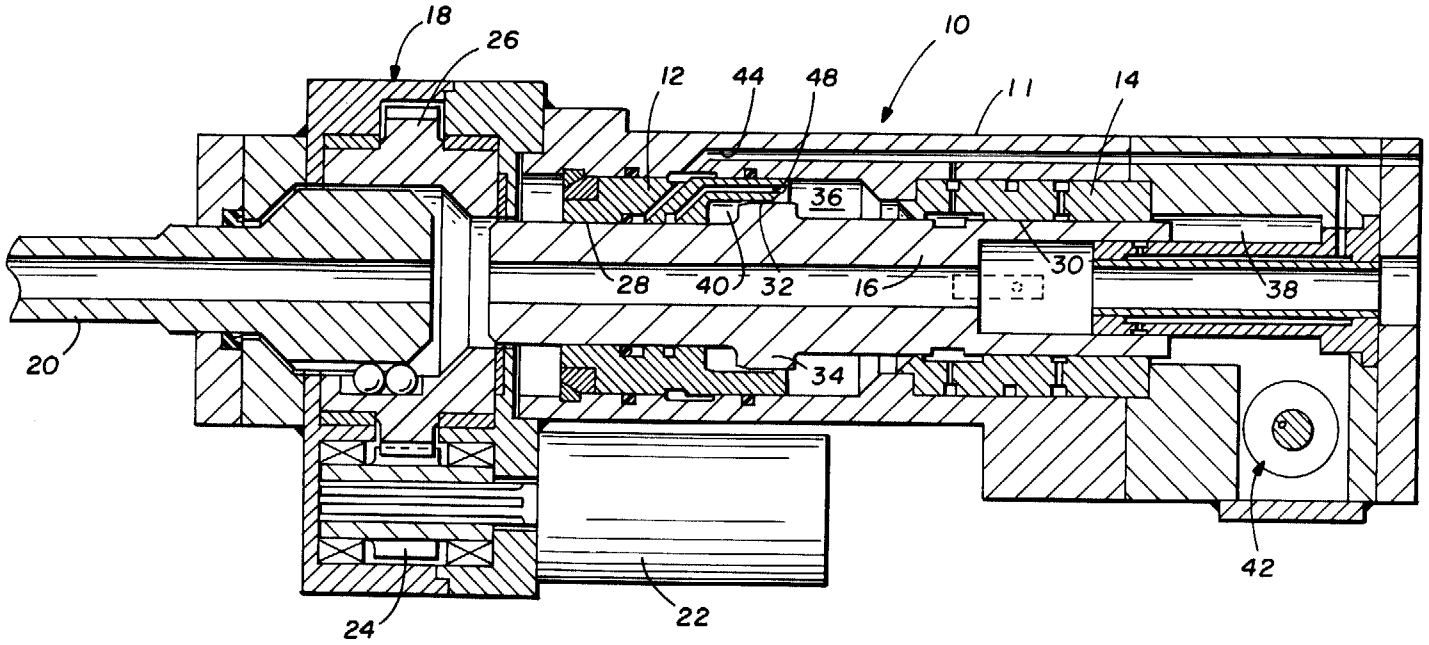
FIG. 1 is a cross-sectional view of a hydraulically powered percussion drill constructed in accordance with the invention.

Referring to the drawing and FIG. 1 in particular, shown therein and generally designated by the reference character 10 is a hydraulically actuated percussion drill constructed in accordance with the invention that includes a housing 11, a source of hydraulic fluid (not shown) and a source of compressed air (not shown). Located within the housing 11 are inwardly projecting bearing portions 12 and 14 that are spaced apart and arranged to support a striker piston 16 for reciprocating movement relative to the housing 11.

Attached to the lower end of the housing 11 is a drill rotation assembly 18 which supports a drill steel 20 for both rotational and reciprocating movement. A motor 22 is attached to the drill rotation assembly 18 and is provided with output shaft carrying a pinion 24 that engages a gear 26 for causing rotation of the drill steel 20.

The inwardly projecting bearing portion 12 of the housing 11 includes a bore 28 sized to closely receive one end portion of the piston 16. An inwardly projecting bearing portion 14 of the housing 11 includes a bore 30 sized to receive the other end portion of the piston 16. The bearing portion 12 also includes a counterbore 32 that is slightly larger in diameter than the outer diameter of a flange 34 on the striker piston 16. It will also be noted that the diameter of the bore 28 and the outer diameter of that portion of the striker piston 16 extending therethrough is slightly smaller than the diameter of the bore 30 in the bearing portion 14 and the outside diameter of the end portion of the piston 16 disposed therein.

The arrangement of the housing 11, the bearing portions 12 and 14 and the striker piston 16 forms a first chamber 36 and a second chamber 38 in the housing 11. The counterbore 32 in the bearing portion 12 defines as overtravel portion 40 that is located at one end of the first chamber 36.

The drill 10 also includes a control valve assembly generally designated by the reference character 42 that is constructed to constantly pressurize chamber 36 and to alternately pressurize the chamber 38 to cause the piston 16 to reciprocate in the housing 11. A more complete description of the structure and operation of the control valve assembly 42 and the method by which the chambers 36 and 38 are pressurized is contained in previously mentioned U.S. Pat. No. 3,701,386.

Figure 2:
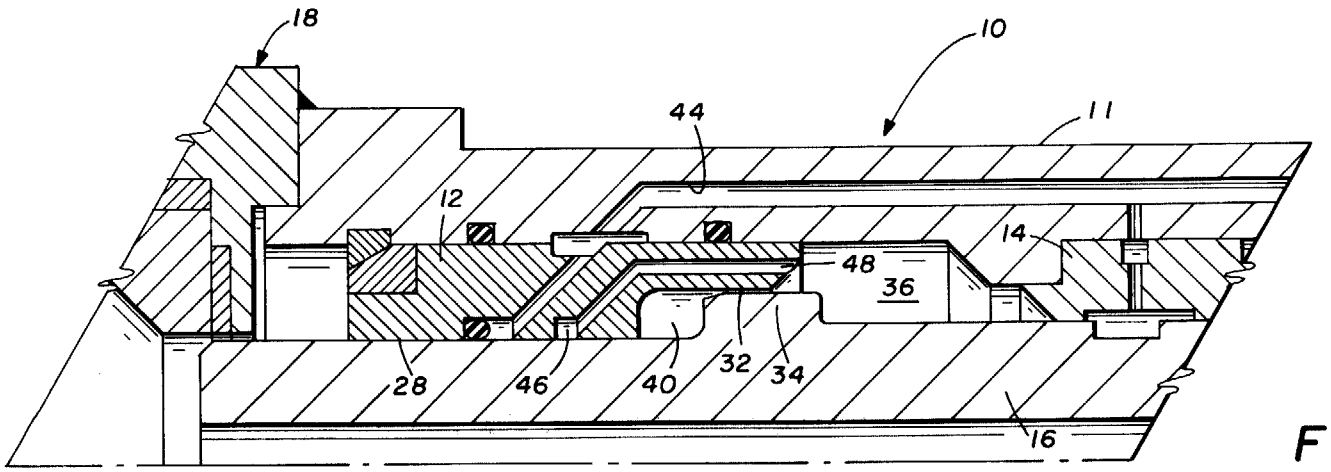
FIG. 2 is an enlarged fragmentary cross-sectional view illustrating a portion of the hydraulically powered percussion drill of FIG. 1.

The details and construction of the striker piston 16 and the bearing portion 12 of the housing 11 can be more clearly seen in the enlarged fragmentary view of FIG. 2. As shown therein, it can be seen that there is a clearance existing between the outer diameter of the flange 34 on the piston 16 and the inner periphery of the counterbore 32 forming the overtravel portion 40 of the chamber 36. The clearance is provided so that as the piston 16 is driven into the overtravel portion 40, the hydraulic fluid contained in the counterbore 32 is metered from the overtravel portion 40 into the chamber 36. However, the viscosity may be sufficiently high so that the hydraulic fluid may be driven out of the overtravel portion 40 into a low pressure return passageway 44 formed in the housing 11. When this occurs, a differential in pressure exists between the chamber 36 and the overtravel portion 40 across the flange 34 tending to stall the piston 16 in the overtravel portion 40 with the flange 34 located in the counterbore 32.

To overcome the tendency of the piston 16 to stall in the overtravel portion 40, an annular groove 46 is formed in the bearing portion 12 adjacent the piston 16 with a plurality of passageways 48 extending through the bearing portion 12 into communication with the chamber 36. Due to the presence of the passageways 48 and the annular groove 46, the pressure in the overtravel portion 40 is maintained substantially the same as the pressure in the chamber 36.

Since the diameter of the piston 16 is smaller in the bearing portion 12 than in the bearing portion 14, a differential in area exists across the flange 34 so that fluid pressure in the chamber 36 forces the piston 16 toward the right as viewed in FIG. 2, that is, toward the return position of the piston 16.

OPERATION OF THE PREFERRED EMBODIMENT

As illustrated in FIG. 1, the drill steel 20 is at the leftmost position where it cannot be contacted by the striker piston 16. This is the position of the drill steel 20 when the drill 10 is being moved away from the formation to be drilled. When in this position, and without the passageways 48, the piston 16 may become stalled in the overtravel portion 40 and thus, not reciprocate to provide vibration to the drill steel 20 to aid in loosening it as the drill steel is removed from the hole being drilled. If the piston 16 is contacting the drill steel 20, such as during the drilling of the hole, the rebound of the striker piston 16 off the drill steel 20 will normally prevent stalling of the piston 16 in the overtravel chamber 40.

With the various components in the position illustrated in FIG. 1, the chamber 38 has been pressurized driving the piston 16 toward the left side of FIG. 1 with the flange 34 on the piston 16 entering the overtravel chamber 40. The deceleration of the piston 16 as the flange 34 enters the overtravel portion 40 is governed by the shape of the flange, clearance between the exterior of the flange 34 and the inner periphery of the counterbore 32 and the viscosity of the hydraulic fluid. It is, of course, essential that the motion of the piston 16 will be completely arrested before the flange 34 impacts the bearing portion 12 of the housing 11. Such an impact could ultimately result in destruction of the drill 10.

With the passageways 48 and the annular groove 46 providing communication between the chamber 36 and the overtravel portion 40, the pressure remains substantially balanced despite the rapid entrance of the flange 34 into the overtravel chamber 40. Thus, and with the pressures substantially equal, the additional area provided by the reduced diameter portion of the piston 16 in the bore 28 causes the piston 16 to move toward the right side of FIG. 1, thus, avoiding stalling of the piston 16.

Since the chamber 36 is constantly pressured, such pressure passes through the passageways 48, the annular groove 46 and into the overtravel chamber 40 maintaining the pressure substantially equal across the flange 34 so that the piston 16 will positively be returned to the right hand position as viewed in FIG. 1. With the structural arrangement described, the piston 16 will reciprocate rapidly during the "running free" operation of the drill 10, imparting vibrations to the housing 11 and the drill steel 20 to aid in removing the drill steel 20 from the hole being drilled.

DESCRIPTION OF THE MODIFICATION OF FIG. 3

Figure 3:
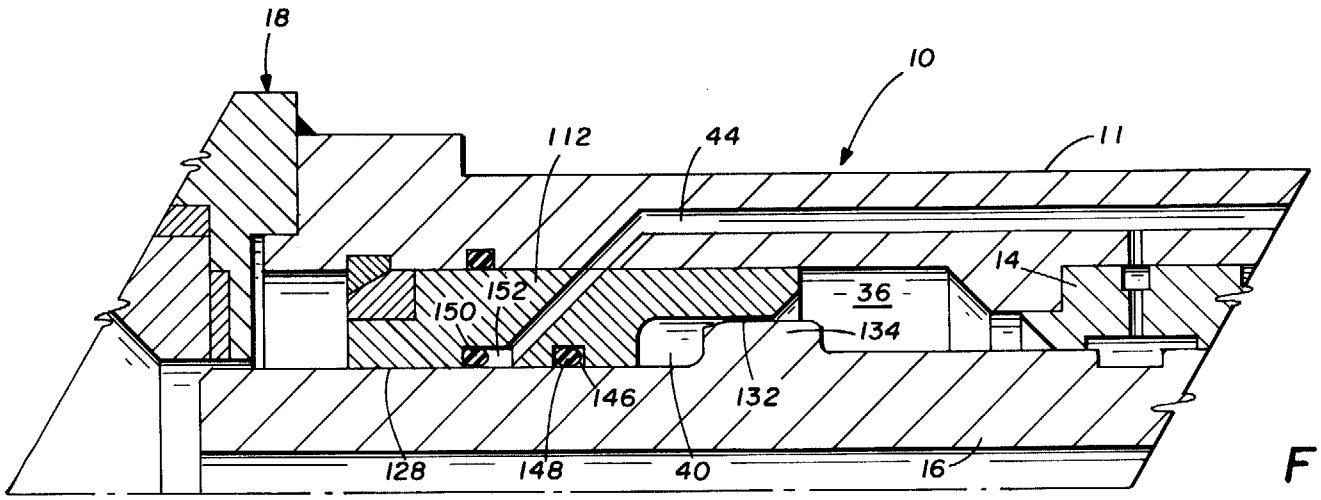
FIG. 3 is an enlarged fragmentary cross-sectional view similar to FIG. 2 but illustrating a modification of the drill that is also constructed in accordance with the invention.

The enlarged fragmentary view of FIG. 3 illustrates a modification to the structure previously described that is also effective in preventing stalling of the piston. In view of the relatively slight change in structure, all components of the percussion drill 10 will be designated by the same reference characters previously used except those components that are actually changed.

The primary modification consists of a change in the inwardly projecting bearing portion 12 which is designated in FIG. 3 by the reference character 112. It will be noted that the bearing portion 112 includes a bore 128 extending therethrough that is sized to slidingly receive the piston 16. A counterbore 132 is formed in the bore 128 of the bearing portion 112 to provide the overtravel portion 40 of the chamber 36. As previously mentioned, the counterbore 132 is slightly larger in diameter than the diameter of the flange 34 on the piston 16 for the reasons previously mentioned.

An annular groove 146 is formed in the bearing portion 112 adjacent the smaller diameter portion of the piston 16. A seal 148 is disposed in the annular groove 146 in fluid-tight sealing engagement with piston 16 and with the bearing portion 112. The seal 148 is located between a seal 150 disposed in a second annular groove 152 which is connected with the low pressure return passageway 44 and the overtravel portion 40.

With the arrangement shown in FIG. 3, fluid is effectively prevented from being discharged out of the overtravel chamber 40 as the flange 34 enters therein by the seal 148. Thus, and since fluid cannot escape from the overtravel chamber 40, the pressure in the overtravel chamber 40 and in the chamber 36 will remain substantially balanced. It will be remembered that the portion of the piston 16 adjacent the bearing portion 112 is of smaller diameter than the portion of the piston 16 disposed within bearing portion 14 and, thus, the pressure forces acting across the differential area of the piston 16 are effective to return the piston 16 to the right as viewed in FIG. 3 and as previously described in connection with the structure of FIG. 2.

From the foregoing detailed description of the drill 10 and the modification thereof as shown in FIG. 3, it will be apparent that means are provided for effectively preventing stalling of the piston 16 in the percussion drill 10 when the percussion drill is "running free," that is, when the striker piston 16 does not engage the drill steel 20. Accordingly, it is possible to operate the drill 10 in the "running free" condition to impart vibrations to the drill which will be effective in aiding to release the drill steel 20 if it becomes stuck in the hole being drilled.

It will also be understood that the foregoing detailed description is presented by way of example only and that many changes and modifications can be made thereto without departing from the spirit and scope of the invention.

The embodiments of an invention in which an exclusive property or privilege is claimed are defined as follows:

1. A hydraulically powered percussion drill comprising:

an elongate housing having first and second ends, first and second chambers therein adjacent said first and second ends, a bore of smaller diameter than said first chamber extending from said first chamber through said first end, an overtravel portion in said first chamber of a diameter intermediate said bore and first chamber and first and second annular grooves in said bore spaced at a distance from said overtravel portion;

an elongate striker piston located in said housing for reciprocating movement, said piston including a first end portion fitting closely and slidingly disposed in said bore, a second end portion partially disposed in said first chamber and extending into said second chamber and an annular flange between said end portions sized to fit relatively closely into said overtravel portion to permit restricted fluid flow thereacross, said first end portion being of smaller diameter than said second end portion;

an annular seal located in said first annular groove in said bore in sealing engagement with said housing and the first end portion of said piston;

a first passageway in said housing providing fluid communication between said first annular groove in said bore and a low pressure area in said drill, said passageway having one end intersecting said first groove between said annular seal and said overtravel portion; and a second passageway in said housing providing fluid communication between said second annular groove in said bore and said first chamber outside of said overtravel portion, said second passageway having one end intersecting said a second annular groove in said bore between the intersection of said first passageway with said first groove and said overtravel portion, whereby the pressure in said first chamber and overtravel portion are substantially equal, preventing stalling of said piston when said flange is in said overtravel portion.

* * * * *